US005845433A

United States Patent [19]

Walsh

[11] Patent Number: 5,845,433

[45] Date of Patent: Dec. 8, 1998

[54] ANTI-THEFT DEVICE FOR FRAMED DOOR

[76] Inventor: Michael J. Walsh, 5724 Aluffo Rd., Paso Robles, Calif. 93446

[21] Appl. No.: 783,120

[22] Filed: Jan. 14, 1997

[51] Int. Cl.[6] ..... E05D 11/00

[52] U.S. Cl. ..... 49/383

[58] Field of Search ..... 49/383

[56] References Cited

U.S. PATENT DOCUMENTS

| | | | |
|---|---|---|---|
| 301,221 | 7/1884 | Devers | 49/383 X |
| 525,641 | 9/1894 | Wilson | 49/383 X |
| 772,611 | 10/1904 | Ferrara | 49/383 |
| 1,973,461 | 9/1934 | Barringer | 49/383 X |

FOREIGN PATENT DOCUMENTS

| | | | |
|---|---|---|---|
| 2604476 | 4/1988 | France | 49/383 |
| 140682 | 2/1935 | Germany | 49/383 |
| 2277345 | 10/1994 | United Kingdom | 49/383 |

*Primary Examiner*—Jerry Redman

[57] ABSTRACT

A device for preventing unauthorized prying of a door outward or forcing it inward from the plane of the door wherein the door is pivotally mounted on hinges in a door frame, the door and door frame each having interior surfaces, including a first member, including a base, for mounting to the interior surface of the door frame and having formed thereon a protrusion facing outward from the base toward the door, and a second member for mounting to the interior surface of the door, the second member, defined by a base, for attachment to the interior surface, and a body extending upward and away from the base having formed therein a recess facing outward toward the protrusion and arranged to pivot with the door away from and toward the protrusion as the door is opened and closed, wherein the first and second members are arranged for pivotal movement away from each other when the door is opened and into interlocking association when the door is closed in the frame to resist attempts to pry the door outward from the frame.

11 Claims, 3 Drawing Sheets

ANTI-THEFT DEVICE FOR FRAMED DOOR

BACKGROUND OF THE INVENTION

1. Field of the Invention

This invention pertains to the field of anti-theft devices used in safes and restricted-entry cabinets to resist the act of prying the door from the safe or cabinet during attempts to gain unauthorized entry thereinto. More particularly, this invention pertains to a simple but effective placement of small members about the frame of the door and about the perimeter of the door itself that interact in unique ways to resist these unauthorized entries without unduly interfering with the act of entering or withdrawing items of value therefrom.

2. Description of the Prior Art

It seems that no matter how much effort one expends to lock something in private, there are those persons who spend an inordinate amount of time attempting to gain entrance to it. This seems to be significantly noticeable in the area of automatic teller machines or ATMs and safes.

ATMs are machines accessible by the public for the purpose of making deposits of cash into and withdrawing cash from bank accounts when the bank is either not opened or when the user is geographically dislocated from the bank building. In order to be able to dispense cash into the hands of the account holder, on demand, it is first necessary to load the machine with cash. This has had the effect of exciting the criminal mind and enticing certain individuals to attempt to remove the cash from the machine without authorization.

The attempts have followed along three general paths. The first is to steal the authorization code from a user by trickery and then use this code to enter the account and falsely obtain money from the machine. The second is just to hold up the account holder with a weapon after the holder has legitimately obtained money from the ATM machine. The third is to pry open the door of the ATM machine and reach in and take cash that has been loaded therein for legitimate dispensing to account holders.

The door covering over entrance ways into ATM machines are of a general design where a door frame is formed comprising a top door sill or lintel, a bottom door sill and opposed, spaced-apart vertical door jambs, where the sills and jambs are joined together at their respective terminal ends to form a rectangular frame. The frame surrounds the portal or entrance into the interior of the ATM machine where cash is kept, deposits are stored, and where the controls or drive engines of the machine may be accessed. The door is mounted in the frame and pivotally held in place by hinges placed along one vertical jamb. A lock and/or security handle is located opposite the hinges and is used to pull the door open and push it closed and locked.

The frame, door, hinges and handle are generally made very strong so that access through them is clearly denied. Accordingly, unauthorized access usually takes place at locations on the door or around its perimeter adjacent the door frame. A popular access point on ATM doors is between the dead bolt under the lock handle where it slides into a recess in the frame. This is breached by prying the door with a pry bar placed between the outer edge of the door and the inner edge of the door frame to spread open the space between the bolt and the receptacle so that the door springs loose when the dead bolt is released from reception in the opening in the door frame.

Another popular access point is along the door jamb on which the hinges are attached. Mere spreading of this distance with a pry bar is often sufficient to produce an opening in between the door and frame sufficient for one to insert their hand and arm to grab cash interior the machine and pull it out. Actually, any way to pry the door from the frame, either inward toward the center of the door in the plane of the frame or inward or outward from the plane of the door frame, will often result in creating an opening sufficiently large to gain unauthorized access to the interior of the ATM machine.

One rather obvious answer to this dilemma is to thicken the door and the jamb or make them of stronger and heavier metal. While such a cure is within the grasp of today's manufacturers, it represents a significant increase in material cost and in fabrication time, while at the same time making the machine heavier, more difficult to install and requiring a heavier support base.

What is needed is a light weight device for installation at points of probable entry into the ATM machine that will use some of the features already a part of the machine, such as the stiffness of members already in place and cabinet locking systems. This way the amount of material increase will be modest, the machine will remain at its present weight or, at least, not become more severely overweight, and the invention can be retrofitted on existing ATM machines without having to modify the support base or otherwise alter the present design of the machine.

SUMMARY OF THE INVENTION

This invention comprises devices which may be built into or retrofitted into existing ATM machines or safes or the like that significantly resist unauthorized entry through the door or between the door and the frame of the machine. The devices are unique geometrical designs of mild steel that are made to maximize their strength without interfering with the use of the machine, the opening or closing of the doors or with access to the interior of the machine.

The invention comprises a device for preventing unauthorized prying of a door outward or forcing it inward from the plane of the door wherein the door is pivotally mounted on hinges in a door frame, the door and the door frame each having interior surfaces, comprising a first member, including a base, for mounting to the interior surface of the door frame and having formed thereon a protrusion facing outward from the base toward the door and, a second member for mounting to the interior surface of the door, the second member, defined by a base, for attachment to the interior surface, and a body extending upward and away from the base having formed therein a recess facing outward toward the protrusion and arranged to pivot with the door away from and toward the protrusion as the door is opened and closed wherein the first and second members are arranged for pivotal movement away from each other when the door is opened and into interlocking association when the door is closed in the frame to resist attempts to pry the door outward from the frame.

The invention also includes a device for preventing unauthorized prying of a door outward or forcing it inward from the plane of the door wherein it is pivotally mounted on hinges including a central hinge pin in a door frame and for preventing unauthorized prying of the door away from the door jamb, the door frame including spaced-apart top and bottom door sills, and opposed spaced-apart door frame jambs, attached together at their terminal ends and the door and the door frame each having interior surfaces, comprising a first member including a base for mounting to the interior surface of the door frame and having formed thereon a protrusion facing outward from the base toward the door and, a second member for mounting to the door, defined by a base and a body extending upward away from the base and having formed therein a recess facing outward toward the protrusion, arranged to pivot with the door away from and toward the protrusion as the door is opened and closed, the second member further including a rear surface, and a bar attached to the interior surface of the door frame against each the top and bottom door frame sills, each bar terminating in at least one surface conforming to and closely spaced from the rear curved surface of the second member as the door is closed, wherein the first and second members are arranged for pivotal movement away from each other when the door is opened and into interlocking association and wherein the rear curved surface is moved into close proximity with the bar terminating surface when the door is closed in the frame to resisted attempts to pry the door outward from the frame or sideways away from the door jamb.

The invention also comprises a device for preventing unauthorized prying of a door away from the door jamb wherein it is pivotally mounted on hinges including a central hinge pin in a door frame the door frame including spaced-apart top and bottom door sills, and opposed spaced-apart door frame jambs, attached together at their terminal ends and the door and the door frame each having interior surfaces, comprising a member for mounting to the door, defined by a base for attachment to the interior door surface and a body extending upward away from the base and terminating at a surface closely spaced to the door jamb interior surface when the door is closed in said frame, a bar attached to the interior surface of the door frame against each the top and bottom door frame sills, each bar terminating in at least one surface conforming to and closely spaced from the rear curved surface of the member as the door is closed, wherein the member and the bar are arranged to reside in close proximity to each other when the door is opened and closed to resisted attempts to pry the door outward from the frame or sideways away from the door jamb.

Accordingly, the main object of this invention is a device that significantly strengthens the door to an ATM machine, a safe or the like using small members of strong metal, such as mild steel, in unique ways to thwart the existing practice of prying the perimeter of the door from the door frame, either outward or inward from the plane of the door frame, or inward toward the center of the door in the plane of the frame.

Other objects of the invention include devices that prevent or severely resist the prying of the safe door from the door jamb so that an opening is not made allowing unauthorized access to the interior of the machine; a device that renders the machine safe from unauthorized entry without adding significant amounts of metal such as thickening of the door about its perimeter or shoring up the door frame; a device that will cause other locking devices already on the door and frame to bind and/or jam and prevent opening of the door from the frame, a device that may be retrofitted onto existing ATM machines, safes and the like by simple welding that may be performed on the premises by only moderately skilled work persons thus reducing installation and other labor costs; a device that is wholly contained on the interior surfaces of the door and door frame of the machine so as to be totally out of sight and not accessible by those seeking unauthorized entry into the ATM machine or safe from outside; and, a device that does not detract from the clean lines and aesthetic design of existing ATM machines nor destroys the easy utilization design of existing ATM machines, or destroys the existing utilization of features already in place on the machines.

These and other objects of the invention will become more apparent upon reading the following description of the preferred embodiment taken together with the drawings appended hereto. The scope of protection sought by the inventors may be gleaned from a fair reading of the Claims that conclude this Specification.

DESCRIPTION OF THE PREFERRED EMBODIMENT

Figures 1, 2:
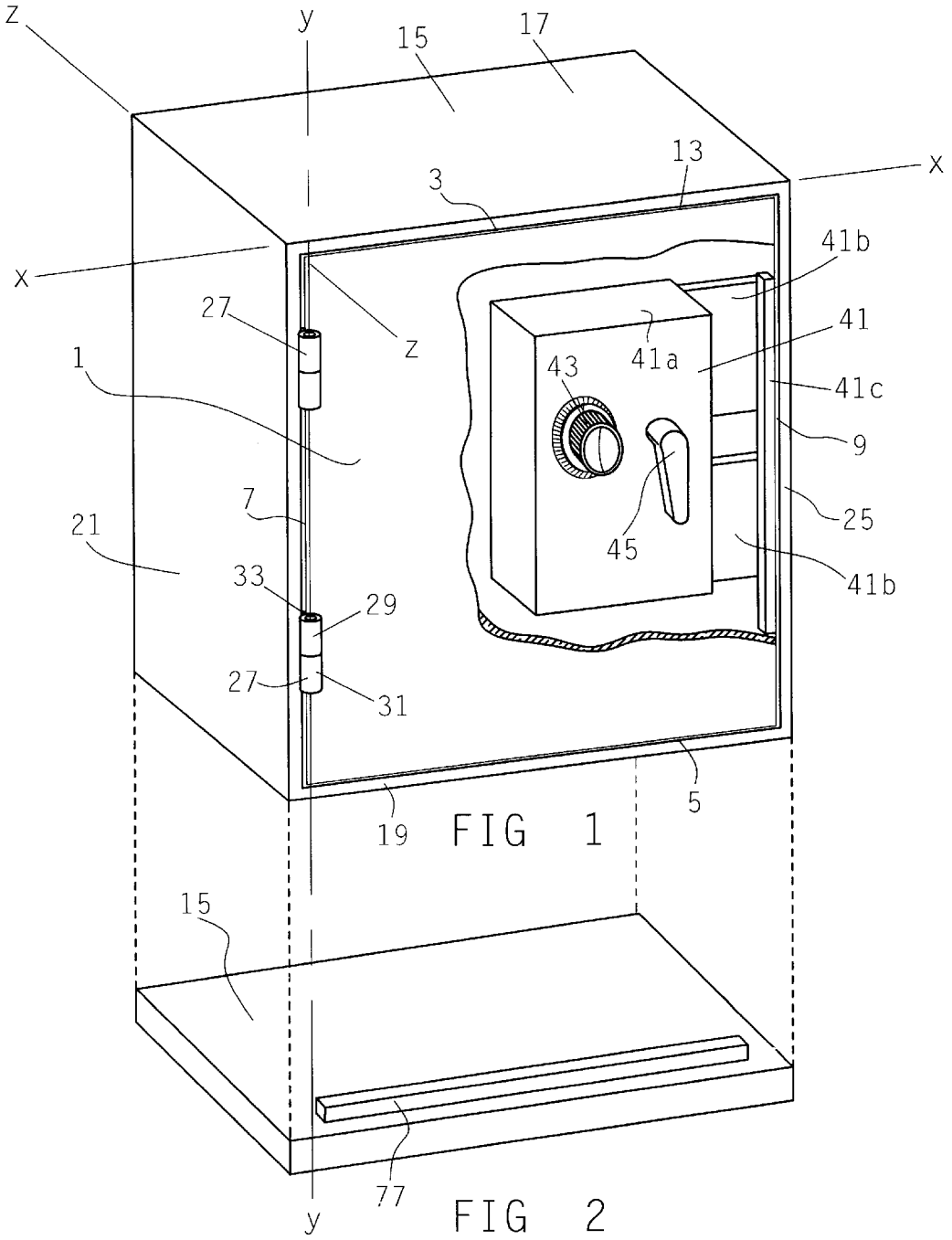
FIG. 1 is an isometric view of a typical ATM cabinet in which this invention can be installed.
FIG. 2 is an illustrative view of the bottom sill of the door frame and door shown in FIG. 1.

Turning now to the drawings wherein like members are identified by like numerals throughout the six figures, FIG. 1 shows a typical cabinet that is part of an ATM machine, a safe or the like and shows a door 1 defined by spaced-apart top and bottom edges 3 and 5, respectively, and a pair of spaced-apart side edges, 7 and 9, forming a perimeter 13, wherein said door 1 is matched to a door frame 15.

Door frame 15 is planar in overall shape, having plane coordinates x-y as shown and is typically comprised of a top sill or lintel 17, held in spaced-apart arrangement from a bottom sill 19 by a pair of side jambs 21 and 25 respectively that are all joined at their terminal ends to form a rectangular entrance to a portal or opening into a typical cabinet. Door 1 is held in pivotal engagement to side jamb 21 by a pair of door hinges 27 that generally comprise two hinge halves 29 and 31 held in pivotal engagement by a hinge pin 33 lying along a vertical axis.

Door 1 and door frame 15 are generally made of strong metal such as mild steel and have a wall thickness ranging from about ⅛ inch to about one (1) inch. The inside surface 37 of door frame 15 and the inside surface 39 of door 1 are generally treated for rust resistance. Hinge halves 29 and 31 are generally fixed in place on door 1 and door frame 15 by welding in order to prevent dismantling thereof by those with a criminal bent.

A locking-bolt device 41 is shown outlined behind a broken away piece of door 1 and comprises a mechanism 41*a*, with moveable locking bolts 41*b* extending outward therefrom for reciprocal motion behind a bar 41*c* located on door jamb 25. A lock 43 and door handle 45 round out the hardware making up the entry way into the ATM machine. While this specification is set forth in terms applicable to an ATM machine, it is specifically to be noted that the invention is applicable to a wide range of doors, to prevent unauthorized access to the interior of cabinets, suit cases, computer terminals, rooms, chambers, cubicals, and the like.

FIG. 2 shows the bottom sill 19 of door frame 15 and shows that pieces of the invention, such a bar 77 of strong metal, can be mounted against sill 19 and held there by welding or some other strong fastening means. More will be explained about bottom sill 19 and bar 77 later in this specification.

Figure 3:
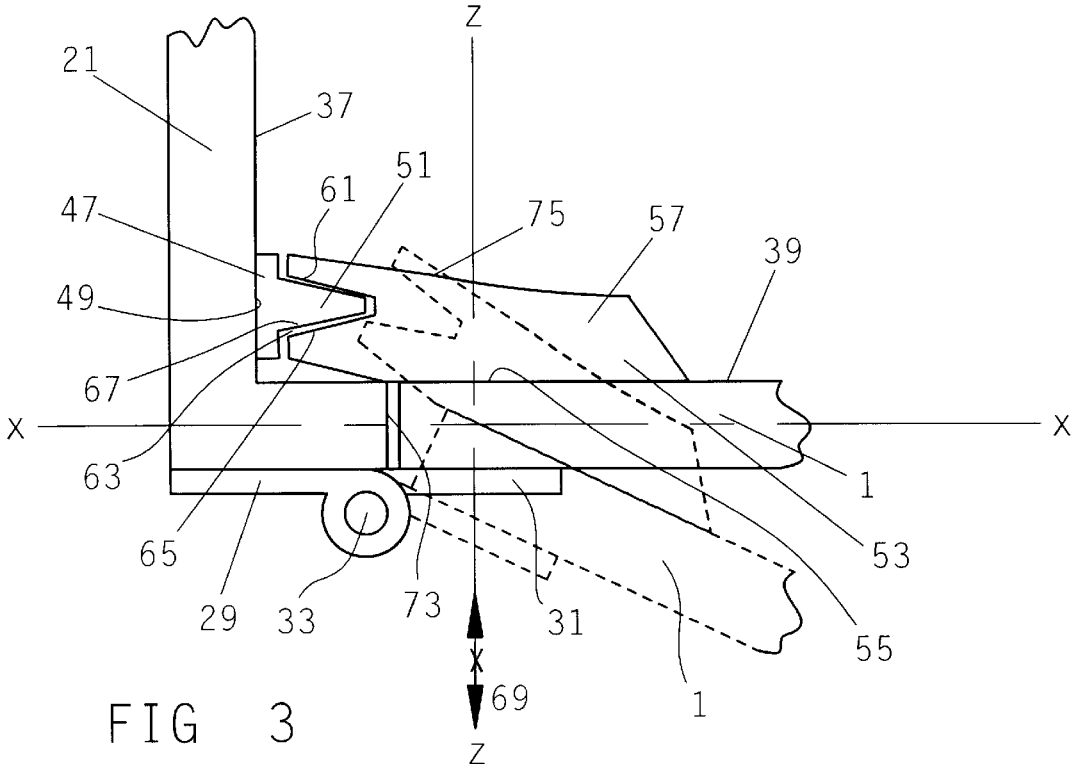
FIG. 3 is an illustrative view of one of the embodiments of the invention that can be used with a hinge in the location shown along lines 3—3 in FIG. 1.

FIG. 3 discloses the first embodiment of this invention and shows it to be used where door 1 is pivotally mounted by hinges 27 to door frame 15. This embodiment of the device of this invention comprises a first member 47, preferably made of mild steel, having a broad base 49, for mounting to inside door frame surface 37 by welding or other such fastening means, that has formed thereon, above base 49, a protrusion 51 that faces upward and away from base 49 and toward door 1. Base 49 is preferably wider than protrusion 51 to provide greater strength where it is needed.

A second member 53 is provided and defined by a base 55 and a body 57 that extends upward and away from base 55 toward first member 47. Body 57 terminates in an end surface 61 wherein is formed a recess 63, preferably in the shape similar or identical to that of protrusion 51, that faces outward toward protrusion 51 and moves away from and toward said protrusion when door 1 is opened and closed as shown in dotted outline in FIG. 3. The design of protrusion 51 is such that its base 49, along with base 55 of second member 53, are sufficiently broad as to act as wedges and provide the maximum amount of metal adjacent the interior surfaces 37 and 39 of frame 15 and door 1 respectively. This allows for more welding and greater contact area for first and second members 47 and 53 so that these relatively small parts provide a maximum of protection. In addition, the outline of protrusion 51 and recess 63 is preferably "V" shaped or "U" shaped to provide greater amounts of metal at the bottom of the recess for safety reasons.

When first member 47 and second member 53 engage upon door 1 closing into door frame 15, and protrusion 51 enters recess 63, there is produced at least one co-acting set of surfaces, namely surfaces 65 and 67 respectively on protrusion 51 and on recess 63, that come together and prevent someone from prying door 1 out of plane x-y of door frame 15. Usually door frame plane x-y is the same as the door plane and, in most cases, the planes can be considered as superimposed on each other. A double-ended arrow 69 is shown on FIG. 3 passing in the direction of the "z" axis with an "x" through it showing that this embodiment of the invention prevents prying of door 1 outward or inward from plane x-y (termed "translational movement") which are the planes of door frame 15 and of door 1. This would be attempted by the criminal inserting a pry bar into space 73, between door 1 and the front edge of door frame 15, and prying door 1 outward from plane x-y. While the pry bar is not shown in FIG. 3, it is easy to see that broad base 49 of first member 47 co-acts with base 55 of second member 53 to provide a substantial amount of metal that, together, resists this prying motion. In this embodiment, the shape or dimension of the rear surface 75 of second member 53 is not important and does not enter into operation during opening and closing of door 1. Base 49 is preferably wider than protrusion 51 to provide greater strength where it is needed. This embodiment also causes locking bolts 41*b* to become jammed behind bars 41*c* so that existing locking bolt device 41 is caused to become bound up (see FIG. 1). This augments the action of this invention and provides for more resistance against unauthorized entry into the ATM machine or safe.

Figure 4:
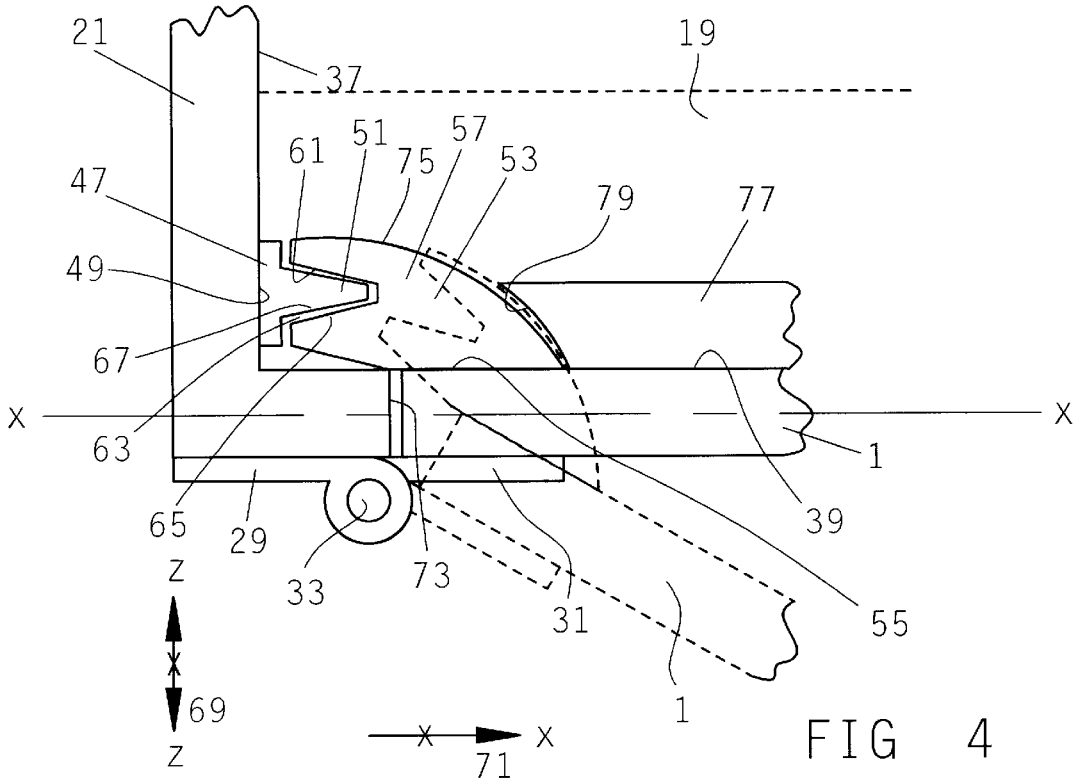
FIG. 4 is another illustrative view of a modification of the invention shown in FIG. 3.

As shown in FIG. 4, this invention can be modified to perform double duty, namely to prevent door 1 from being pried out of the plane x-y of frame 15 (and door 1) as well as prevent door 1 from being pried sideways away from door jamb 21 or 25 in the plane of door 1. As shown, first member 47 and broad base 49 are mounted as shown in FIG. 3 by welding or other such fastening means and includes protrusion 51 that faces upward and away from base 49 and toward door 1.

Second member 53 is also provided, defined by base 55 and body 57, that extends or curves up and away from base 55 toward first member 47. Body 57 terminates in end surface 61 wherein is formed recess 63, preferably concave, that faces outward toward protrusion 51 and moves away from and toward said protrusion when door 1 is opened and closed as shown in dotted outline in FIG. 3. The design of protrusion 51 is the same, namely, that its base 55 is sufficiently broad as to act as a wedge and provide the maximum amount of metal adjacent interior surfaces 37 and 39 of frame 15 and door 1.

When first member 47 and second member 53 engage upon door 1 closing into door frame 15, and protrusion 51 enters recess 63, there is produced at least one co-acting set of surfaces, namely surfaces 65 and 67 respectively, that come together and prevent someone from prying door 1 out of plane x-y of door frame 15. Usually door frame plane x-y is the same as the door plane and, in most cases, the planes can be considered as superimposed on each other. A double-ended arrow 69, in the direction of axis "z", is shown on FIG. 4 with an "x" through it showing that this embodiment of the invention prevents prying of door 1 outward or inward from plane x-y (termed "translational movement") which is the plane of door frame 15 and of door 1. Also another arrow 71, in the direction of axis y—y, is shown with an "x" through it showing that this embodiment of the invention prevents prying of door 1 away from near side door jamb 21. This would be attempted by the criminal inserting a pry bar into space 73, between door 1 and the front edge of door frame 15, and prying door 1 outward from plane x-y. While the pry bar is not shown in FIG. 4, it is easy to see that broad base 49 of first member 47 co-acts with base 55 of second member 53 to provide a substantial amount of metal that, together, resist this prying motion. Again, this embodiment also causes locking bolts 41*b* to become jammed in holes 41*c* so that existing locking bolt device 41 is caused to become bound up. This augments the action of this invention and provides for more resistance against unauthorized entry into the ATM machine or safe.

In this embodiment however, the shape or dimension of the rear surface 75 of second member 53 is important and does enter into operation during opening and closing of door 1. FIG. 4 shows a bar 77 mounted against sill 19 and held there by welding or some other strong fastening means. Bar 77 terminates at an end 79 in a curved surface, as shown, that is closely spaced to second member rear surface 75. This closeness is maintained during opening and closing of door 1 in frame 15 as shown in dotted outline in FIG. 4 because rear surface 75 is made on a radial from hinge pin 33 and thus remains at the same distance from pin 33 throughout opening and closing of door 1.

This is the second line of protection, namely that while the co-acting of first and second members 47 and 53 prevent door 1 from being pried out of plane x-y of door 1, the interaction of bar 77 on rear surface 75 of second member 53 prevents door 1 from being pried sideways, away from door jamb 21 in the plane of door 1. Bar 77 prevents second member 53 from moving to the right or the inside of door 1 and away from door jamb 21. In addition, this embodiment also causes locking bolts 41*b* to become jammed in holes 41*c* so that existing locking bolt device 41 is caused to become bound up. This augments the action of this invention and provides for more resistance against unauthorized entry into the ATM machine or safe.

Figure 5:
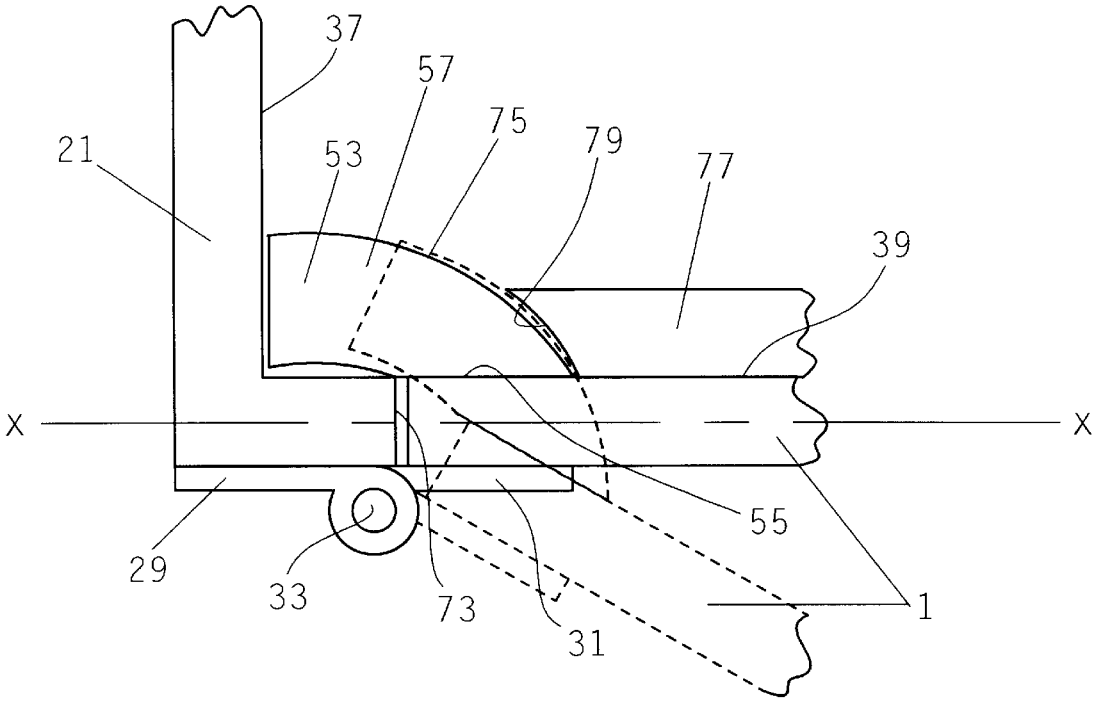
FIG. 5 is still another illustrative view of a modification of the invention shown in FIG. 3; and, FIG. 6 is an illustrative view of one of the embodiments of the invention that can be used in the location shown along lines 6—6 in FIG. 1.

FIG. 5 shows the same members of FIG. 4 without the use of first member 47 with its protrusion 51 and second member 53 with its recess 63. It does utilize bar 77 with its curved end 79 that co-acts with second member rear surface 73.

Figure 6:
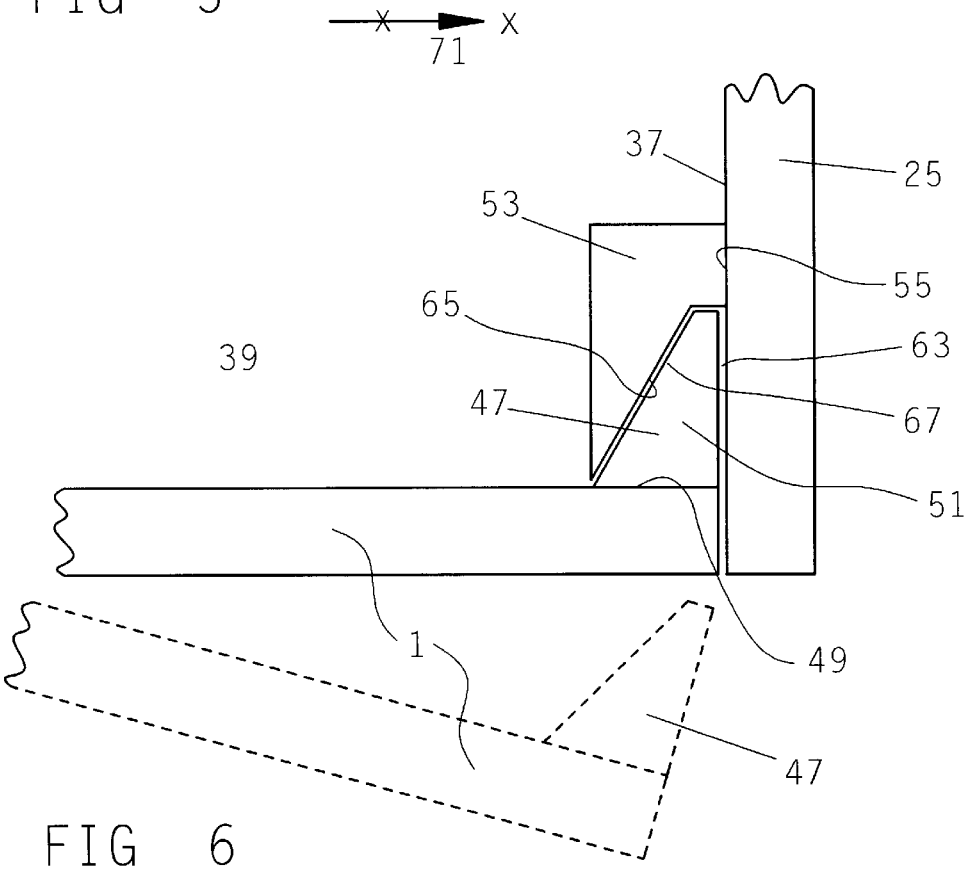

FIG. 6 shows still another embodiment of the invention for use in the area of the door that is located on the opposite side near door side jamb 25. This is the side of door 1 that is not pivotally attached to jamb 25 and door 1 swings outward, away from the plane of jamb 25, when the door is opened.

As shown in FIG. 6, a first member 47 is provided, including a broad base 49, for mounting to interior surface 39 of said door 1 and having formed thereon a protrusion 51 extending upward from base 49 and facing rearward toward the interior of the ATM machine or safe when door 1 is closed. A second member 53 is provided, including a base 55 for mounting against interior surface 37 of door jamb 25, second member 53 having formed therein a recess 63 facing outward toward door 1. First member 47 and second member 53 are arranged for movement away from each other when door 1 is opened, as shown by dotted lines in FIG. 6, and into interlocking association when door 1 is closed in frame 15. When first member 47 and second member 53 engage upon door 1 closing into door frame 15, and protrusion 51 enters recess 63, there is produced at least one co-acting set of surfaces, namely surfaces 65 and 67 respectively, that come together and prevent someone from prying door 1 away from door jamb 25. Base 49 is preferably wider than protrusion 51 to provide greater strength where it is needed. In addition, the outline of recess 63 is preferably "V" shaped or "U" shaped to provide greater amounts of metal at the top of the recess for security reasons. Additionally, this embodiment also causes locking bolts 41*b* to become jammed in holes 41*c* so that existing locking bolt device 41 is caused to become bound up. This augments the action of this invention and provides for more resistance against unauthorized entry into the ATM machine or safe.

While the invention has been described with reference to a particular embodiment thereof, those skilled in the art will be able to make various modifications to the described embodiment of the invention without departing from the true spirit and scope thereof. It is intended that all combinations of members and steps which perform substantially the same function in substantially the way to achieve substantially the same result are within the scope of this invention.

What is claimed is:

1. In an apparatus having a door for opening and closing access thereto, said door hingedly mounted in a door frame, said frame including top and bottom door sills held in spaced-apart arrangement by a pair of spaced-apart frame side jambs, said sills and jambs interconnected at their respective distal ends and lying in a common plane with said door, a device for preventing unauthorized prying of said door out of said common plane and away from said door frame side jambs, comprising:

a) a first member including a first base for mounting to said door frame and having one of a protrusion and recess facing outward from said first base toward said door; and, b) a second member for mounting to said door, defined by a second base and a body extending upward away from said second base and having the other of said protrusion and said recess, said second member facing outward toward said first part, said second member arranged to pivot with said door away from and into interlocking engagement with said first member as said door is opened and closed;

c) said second member further including a rear surface; and, d) a bar attached to said door frame, one against each said top and bottom door frame sills, each said bar terminating in a surface conforming to and closely spaced from said rear surface of said second member when said door is closed to resist attempts to pry said door sideways away from said frame side jamb.

2. The device of claim 1 wherein said base of said first member is wider than said protrusion.

3. The device of claim 1 wherein said recess is formed on said first member and said protrusion of said protrusion/recess connector is formed on said second member.

4. The device of claim 1 wherein said protrusion is "V" shaped.

5. The device of claim 1 wherein said recess is "U" shaped.

6. The device of claim 1 wherein said rear surface of said second member is curved and said terminating surface of said bar is arranged to remain close to said curved rear surface of said second member when said door is opened and closed.

7. In an apparatus having a door closing over its interior, for opening and closing access thereto, said door including exterior and interior surfaces and hingedly mounted in a door frame, said frame including top and bottom door sills held in spaced-apart arrangement by a pair of spaced-apart frame side jambs, said sills and jambs interconnected at their respective distal ends and lying in a common plane with said door, a device for preventing unauthorized prying of said door out of said common plane and away from said door frame side jambs, comprising:

a) a first member including a first base for mounting to said door frame and having one of a protrusion and recess facing outward from said first base toward said door; and, b) a second member for mounting to said door, defined by a second base and a body extending upward away from said second base and having the other of said protrusion and said recess, said second member facing outward toward said first member, said second member arranged to pivot with said door away from and into interlocking engagement with said first member as said door is opened and closed;

c) a third member, including a third base, for mounting to said interior surface of said door and having one of said protrusion and said recess facing outward from said third base toward said interior of said apparatus when said door is closed; and, d) a fourth member, including a fourth base for mounting against said door side jamb, and having the other of said protrusion and said recess from said third member facing outward toward said third member, said fourth member arranged to move with said door away from and into interlocking engagement with said third member as said door is opened and closed.

8. The device of claim 7 wherein said base of said first member is wider than said protrusion.

9. The device of claim 7 wherein said recess is formed on said first member and said protrusion of said first protrusion/recess connector is formed on said second member.

10. The device of claim 7 wherein said protrusion is "V" shaped.

11. The device of claim 7 wherein said recess is "U" shaped.

* * * * *